US005114107A

United States Patent [19]

Mahn et al.

[11] Patent Number: 5,114,107

[45] Date of Patent: May 19, 1992

[54] APPARATUS FOR SUPPORTING ARCHERY EQUIPMENT

[76] Inventors: Gary Mahn, 9470 Oriole Dr., Coopersville, Mich. 49404; Gary Bowman, 871 Dolphin, S.W., Wyoming, Mich. 49509

[21] Appl. No.: 614,092

[22] Filed: Nov. 14, 1990

Related U.S. Application Data

[63] Continuation-in-part of Ser. No. 487,640, Mar. 1, 1990, abandoned.

[51] Int. Cl.[5] ..... F16M 13/00

[52] U.S. Cl. ..... 248/217.4; 248/316.1

[58] Field of Search ..... 298/309.1, 309.2, 316.1, 298/316.4, 316.6, 546, 684, 689, 511, 512, 513, 514, 530, 532, 534, 535, 539, 216.1, 217.4, 231.4, 231.6; 124/45, 25.5, 25.7; 224/916

[56] References Cited

U.S. PATENT DOCUMENTS

| | | | |
|---|---|---|---|
| 1,548,128 | 8/1925 | Fisher . | |
| 2,012,941 | 9/1935 | Corron . | |
| 2,206,775 | 7/1940 | Hoofer | 248/231.4 |
| 2,275,870 | 3/1942 | Sheldon . | |
| 2,301,180 | 11/1942 | Hynek | 248/539 |
| 2,954,764 | 10/1960 | Stinson . | |
| 3,114,485 | 12/1963 | Whiffen . | |
| 3,116,730 | 1/1964 | Tingley . | |
| 3,221,957 | 12/1965 | Roloff . | |
| 3,343,638 | 3/1969 | Beynon . | |
| 3,380,697 | 4/1968 | Melcher . | |
| 3,490,662 | 1/1970 | Ramsey | 224/916 |
| 4,410,095 | 10/1983 | Dembicks . | |
| 4,413,706 | 11/1983 | Michael | 248/216.1 |
| 4,620,736 | 11/1986 | Shanks . | |
| 4,697,669 | 10/1987 | Bergsten . | |
| 4,844,388 | 7/1989 | Kuba | 248/231.6 |

*Primary Examiner*—Ramon O. Ramirez
*Assistant Examiner*—Robert A. Olson
*Attorney, Agent, or Firm*—Varnum, Riddering, Schmidt & Howlett

[57] ABSTRACT

An apparatus for supporting a quiver and arrows comprises a holder (100) which includes a primary block (101) and an add-on block (103). The primary block (101) has means (102) for mounting the block to a support surface, a first means (**12*a*″) for presenting an arrow, and means (104) for attaching a quiver to the holder. The mounting means (102) comprises a threaded screw (106) movably mounted to the primary block (101) for movement between a first position where a substantial portion of the screw is retracted within the block and a second position where a substantial portion of the screw extends from the block. The quiver-attachment means (104) comprises two tongues (136) movably mounted to the block for clamping a conventional quiver to the block. The first arrow-presenting means (12*a*″) comprises a channel (112*a*) and a foam pad (110*a*) which define a slot (13*a*″) adapted to receive and frictionally retain an arrow. The add-on block (103) is removably mounted to the primary block (101) and has a second arrow-presenting means (12*b*″). The second arrow-presenting means (12*b*″) includes a channel (112*b*) and a foam pad (110*b*) which define a slot (13*b*″**) adapted to receive and frictionally retain an arrow.

16 Claims, 7 Drawing Sheets

APPARATUS FOR SUPPORTING ARCHERY EQUIPMENT

This is a continuation-in-part of application serial No. 07/487,640, filed Mar. 1, 1990 now abandoned.

BACKGROUND OF THE INVENTION

1. Field of the Invention

This invention relates to supports for archery equipment, and more particularly to an apparatus in which archery equipment such as an arrow and a quiver may be mounted to a tree or similar vertical structure.

2. Scope of the Prior Art

In the sport of bow hunting, the bowman frequently establishes a blind in a tree. While sitting in the blind, the bowman typically disengages the quiver from the compound bow. It is well known to provide some manner of attaching the quiver to the bow for ease in transporting. Frequently, however, the bowman finds that there is no place to put the quiver except for propping it up in some branches in the tree. Further, the bowman sometimes finds it necessary to take a quick second shot with an arrow. This is difficult to do with present equipment because an arrow cannot be easily disengaged from the quiver with one hand and loaded into the bow to make an effective, quick second shot.

Existing devices are available which provide support for a quiver and arrows at ground level which are particularly useful in the sport of archery target shooting. However, these devices are clearly unusable in the sport of bow hunting where it is frequently necessary to provide some sort of support in a tree some distance from the ground.

Accordingly, there is a need for a device which can provide an effective support for a quiver for easy retrieval of arrows therefrom, and further provide some means for quick and easy retrieval of a single arrow to provide for a quick second shot at a selected quarry.

SUMMARY OF THE INVENTION

The present invention provides an apparatus for supporting a quiver and arrows which is safely transportable and provides an effective support for a quiver and easy retrieval of a single arrow. The apparatus comprises a block which has a quiver support on the block adapted to removably mount a quiver to the block. The quiver support includes a clamping element movably mounted to the block for clamping a portion of the quiver to the block.

Preferably, the clamping element includes a body which slides within a recess in the block. A flange member is connected to the body and is generally located exterior to the block. The flange member is further adapted to bear against a side of the block in clamping engagement. The body slidably moves along an axis and has a threaded shaft extending parallel to the axis. A nut is rotatably mounted to the block, but is constrained against movement along the axis. The threaded shaft engages the nut so that rotation of the nut causes the body to move along the axis relative to the block. Typically, the nut is disposed in a T-channel located on a side of the block opposite the side against which the flange member bears.

In another aspect of the invention, the block has a mounting screw movably mounted to the block for movement between a first position where a substantial portion of the screw is retracted within the block, and a second position where a substantial portion of the screw extends from the block. With the screw in the first position, the block is easily transportable, and when the screw is in the second position, the block can be fixedly mounted to a vertical support.

In a further aspect of the invention, the block has an arrow shaft gripping element for releasably gripping the shaft of a single arrow. Preferably, the arrow shaft gripping element comprises a channel in the block which holds a resilient pad to frictionally grip and retain an arrow shaft. A second block, also having an arrow shaft gripping element, can be mounted to the block.

BRIEF DESCRIPTION OF THE DRAWINGS

For a more complete understanding of the invention reference should now be had to the accompanying drawings in which.

DETAILED DESCRIPTION OF THE PREFERRED EMBODIMENTS

Figure 1:
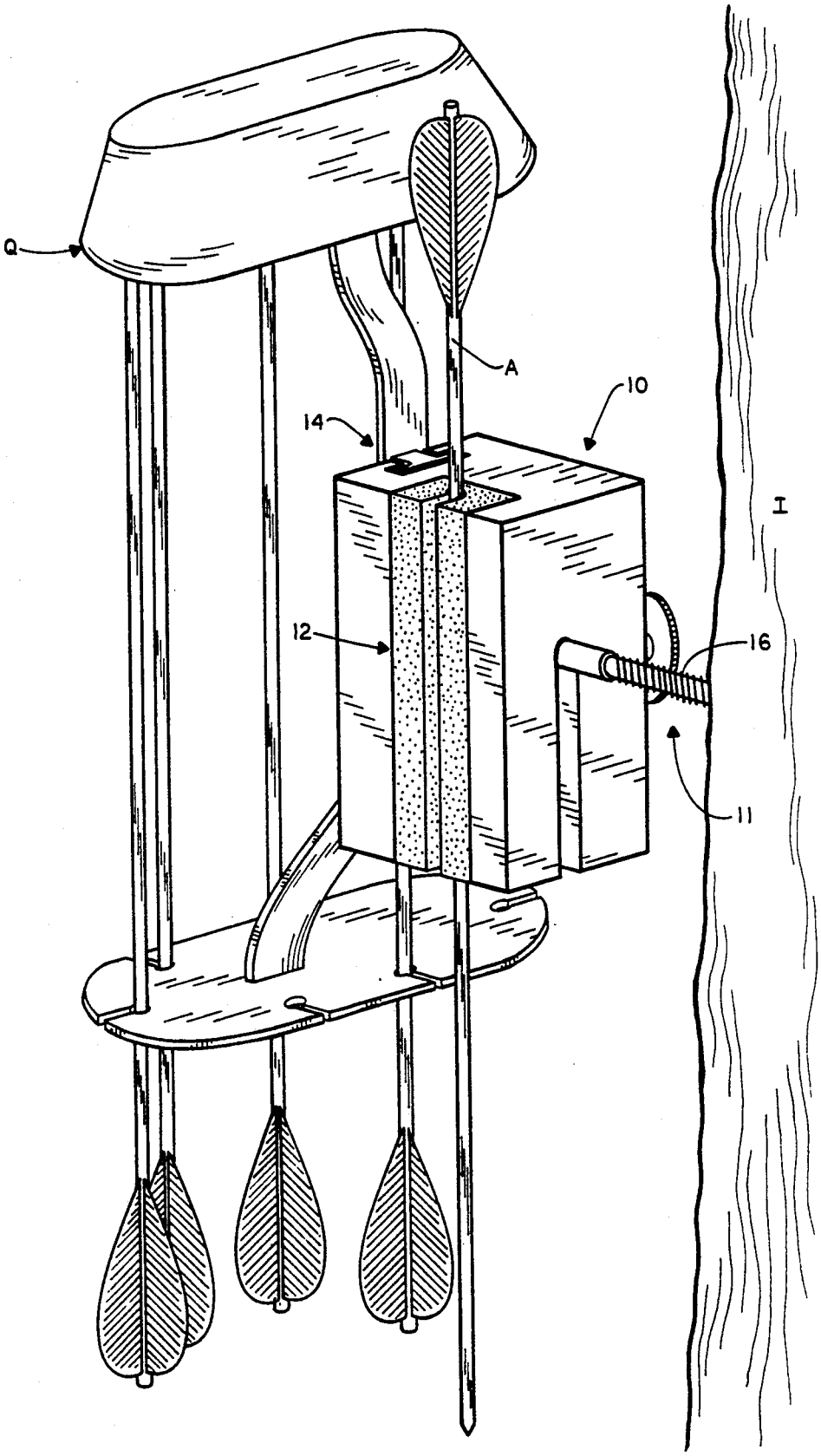
FIG. 1 is a perspective view of an apparatus for supporting archery equipment according to the invention and showing the holder mounted to a tree.
Figure 2:
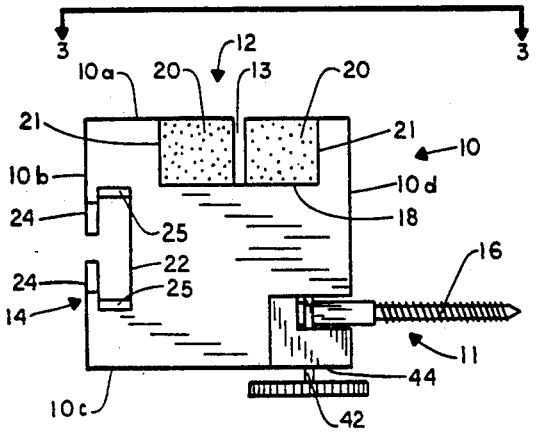
FIG. 2 is a bottom plan view of the arrow and quiver holder of FIG. 1 and showing mounting means therefor in an extended position.

Referring now to FIGS. 1 to 6, an apparatus for supporting archery equipment according to the invention in the embodiment of an arrow and quiver holder is designated generally by the reference numeral 10 and comprises three principal elements: means 11 for mounting the block to a support surface such as a tree T, which means is shown in the form of a pivotally mounted screw 16; means 12 for presenting an arrow A (referred to hereinafter at times as "arrow-presenting means"); and means 14 for attaching a quiver Q (referred to hereinafter at times as "quiver-attachment means"). Together, the arrow-presenting means and the quiver-attachment means constitute means for supporting at least one arrow, the quiver being adapted to hold a plurality of arrows. Preferably, the retainer 10 is constructed of aluminum stock because of the strength, light weight and workability of aluminum, although other materials may be employed. As best shown in FIGS. 1 and 2, the holder 10 is an elongated block-like member having faces 10*a*, 10*b*, 10*c* and 10*d*. The block is intended for mounting to a tree or other appropriate support surface. The block is preferably oriented with the longitudinal axis of the elongated dimension substantially perpendicular to the ground (not shown separately in the drawings). References made herein to "longitudinal," "lateral," "horizontal" or "vertical," are with respect to the orientation of the embodiment in FIG. 1 and for the purpose of facilitating understanding of the invention. As will become apparent, the retainer 10 may be oriented substantially normal to the arrangement of FIG. 1 or at any intermediate angular relationship. Furthermore, the holder 10 itself need not be restricted to the particular shape illustrated.

Figure 3:
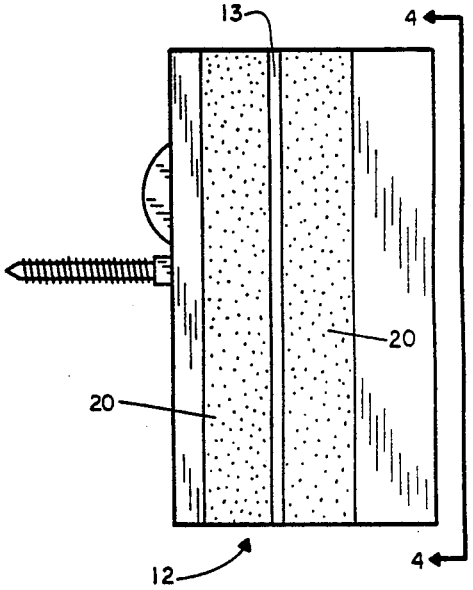
FIG. 3 is an elevational view of the holder of FIGS. 1 and 2 taken along lines 3—3 of FIG. 2.

As best shown in FIGS. 2 and 3, the arrow-presenting means 12 comprises a broad channel 18 machined into and extending the length of the face 10*a* of the holder 10 in the longitudinal direction. Resilient foam pads 20 are adhesively bonded to inside surfaces of the channel side walls 21 and define a slot 13 therebetween which is adapted to receive and frictionally retain the arrow A (FIG. 1).

Figure 4:
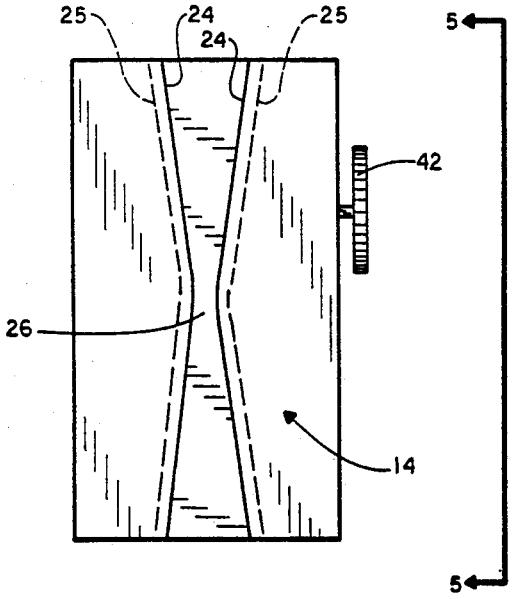
FIG 4. is an elevational view of the holder taken along lines 4—4 of FIG. 3.

As best shown in FIGS. 2 and 4, the quiver-attachment means 14 comprises a second, substantially T-shaped channel 22. The channel 22 is formed in the face 10*b* of the holder 10 and extends in a direction substantially parallel to the direction of the arrow channel 18. As best shown in FIG. 2, channel lips 24 extend partially into the quiver channel 22 to provide the T-shape. The channel 22 is adapted to receive a complementary-shaped tab on the quiver Q (not shown herein, but which is well known in the art, being of the type used to attach the quiver to a compound bow). As best shown in FIG. 4, the quiver channel 22 has a double dovetail configuration such that the channel width defined by the side walls 25 narrows from each end toward a center or throat region 26 thereof. When the tab of the quiver Q is received within the quiver channel 22, the channel lips 24 restrain movement of the quiver horizontally or laterally out of the channel and the throat 26 restrains movement of the quiver vertically downwardly within the channel.

Figure 5:
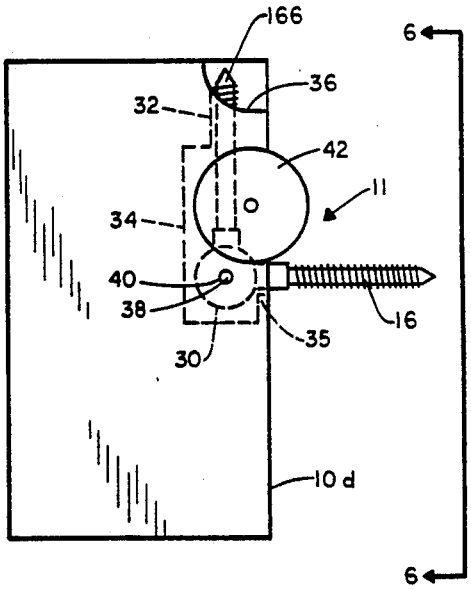
FIG. 5 is an elevational view of the holder taken along lines 5—5 of FIG. 4.
Figure 6:
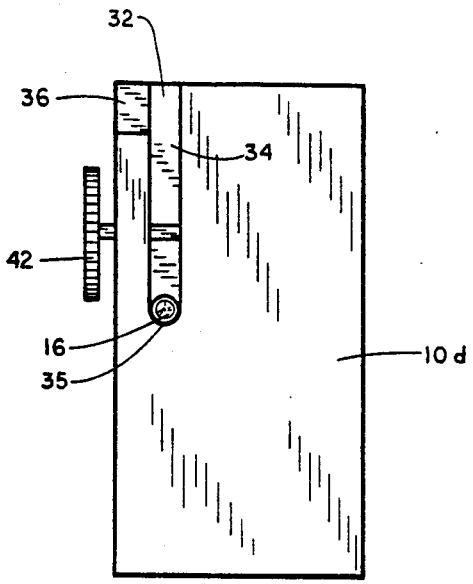
FIG. 6 is an elevational view of the holder taken along lines 6—6 of FIG. 5.

Referring now to FIGS. 2, 5 and 6, the screw 16 is rotatably mounted to a pivot pin 38 which allows the screw 16 to pivot between an extended use position wherein the screw is adapted to engage a support surface such as the tree T (FIG. 1) and a recessed position as shown by phantom lines in FIG. 5. The face 10*d* of the arrow and quiver holder 10 is provided with a vertically oriented deep, narrow first recess 32 and a deeper second recess 34 in which the screw 16 is received when moved to the recessed position. The second recess 34 is undercut on one end to form a second recess lip 35.

A pivot hole 40 penetrates the holder face 10*c* transversely relative to the recess 34. The pivot shaft 38 fits snugly into the pivot hole 40 and is received in tight fit engagement by screw eye 30. The screw 16 extends from the screw eye 30 whereby the screw pivots about the shaft 38 between an extended position abutting the lip 35 and a storage position abutting the first recess 32.

A threaded locking screw hole 44 horizontally penetrates the holder face 10*c*. The locking screw hole 44 threadably receives a locking screw 42 which secures the screw 16 in either the extended use position, lateral to the face 10*c*, or the retracted storage position wherein the screw is received in the first and second recesses 32, 34. When the screw 16 is secured in the extended position by the screw 42, rotational movement is prevented by the second recess lip 35 which extends partially over the second recess 34 to engage the screw 16 and hold it perpendicular to the face 10*d* of the holder 10. The locking screw 42 restrains rotational movement of the screw 16 in the opposite direction. When the screw 16 is in the retracted position, rotational movement is restrained by the first channel 32 and the locking screw 42.

A finger recess 36 is formed by a chamfer in the retainer faces 10*c*, 10*d*, the chamfer intersecting the screw recess 32. A tip 16*b* of the screw 16 extends into the finger recess 36 and may be gripped for rotation while still allowing the tip of the screw to be recessed below the face 10*d* of the holder 10 when the screw 16 is in the retracted position.

In operation, a bowman carries the arrow and quiver holder 10 with the screw 16 locked into the retracted position by the locking screw 42. To mount the arrow and quiver holder 10 to a tree or similar vertical surface, the screw 16 is moved to the extended position by unscrewing the locking screw 42 and removing it from the locking screw hole 44, pivoting the screw 16 to the extended position, and reinserting the locking screw 42 and tightening it into the locking screw hole 44. With screw 16 held firmly in place, the holder 10 may easily be driven into the tree. With the holder 10 firmly screwed to the tree and its longitudinal axis vertically oriented, an arrow may be removed from the quiver and received in the arrow channel 18 between the foam pads 20. Thus, a single arrow is presented for quick, easy and quiet retrieval for a quick shot by the bowman.

A conventional bow quiver mounts to a bow frame by means of a T-shaped tab on the quiver which fits into a T-shaped slot on the bow. The quiver may be removed from the bow frame and mounted to the tree by placing the T-shaped tab on the quiver Q in the quiver channel 22 of the arrow and quiver holder 10. Horizontal movement of the quiver is restrained by the channel lips 24 and vertical downward movement is restricted by the throat 26. The quiver is thus supported for easy access while freeing the bowman's hands to manipulate the bow and arrows.

A second embodiment of the invention, shown in FIGS. 7–11, has a spring-loaded, retractable, screw-threaded mounting means 51, a simplified quiver-attachment means 52 and an arrow-presenting means 12' similar to that in the first embodiment. The arrow-presenting means 12' is comprised of a vertically oriented channel machined into the side of the arrow- and quiver-holder block 10'. Foam pads 20', affixed by means of adhesive to each side of the arrow channel 18', are adapted to frictionally retain an arrow therein.

Figure 7:
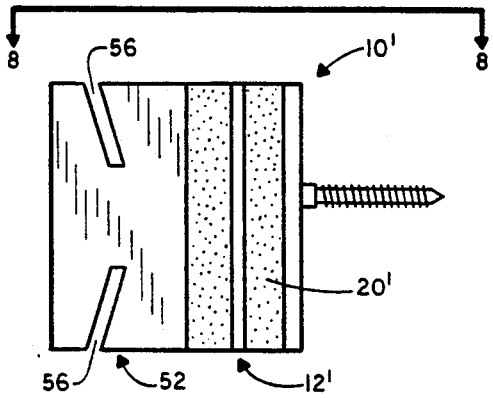
FIG. 7 is an elevational view of a second embodiment of an apparatus for supporting archery equipment according to the invention showing a holder.
Figure 8:
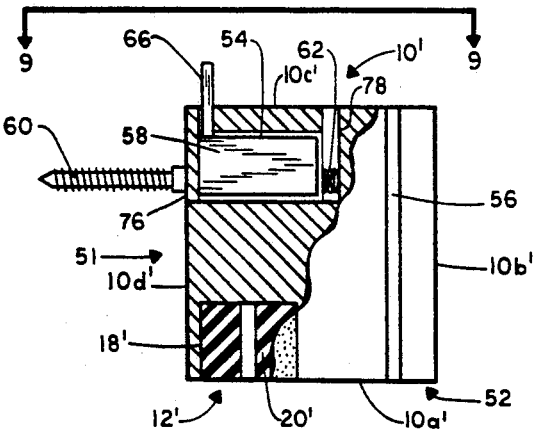
FIG. 8 is a plan view of the holder taken along lines 8—8 of FIG. 7 partially broken away to show interior detail.
Figure 9:
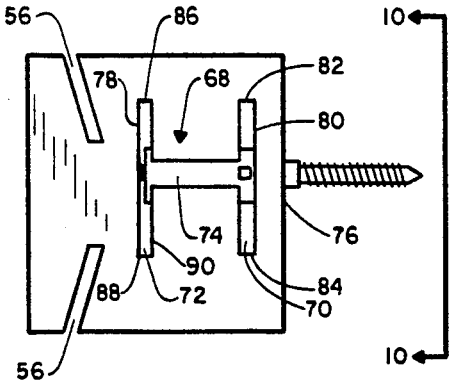
FIG. 9 is an elevational view of the holder taken along lines 9—9 of FIG. 8.

The block 10' has surfaces 10*a'*, 10*b'*, 10*c'*, and 10*d'*, similar in orientation to corresponding surfaces on the first embodiment. As shown in FIGS. 7–9, the quiver-attachment means 52 is provided by an angled slot 56 cut in an end of the block 10' and extending from surface 10*a'* to surface 10*c'*. Preferably, the slot 56 is approximately adjacent the surface 10*b'*. A symmetrical slot 58 is provided in the opposing end of the block 10'. A conventional quiver has a cup portion to protect the arrow points (see FIG. 1), and the slot 56 is adapted to receive a lip of the cup so that the quiver will hang from the block 10'. The opposing slot 58 may also be used to support the quiver in like manner if it is desired to rotate the block 10' to locate the arrow-presenting means 12' at a different orientation with respect to the tree.

Figure 11:
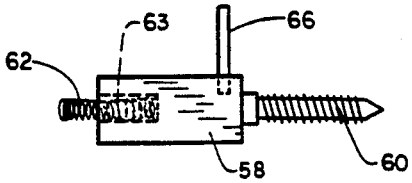
FIG. 11 is a detailed view of the screw mechanism of the holder of FIGS. 7–10.
Figure 12:
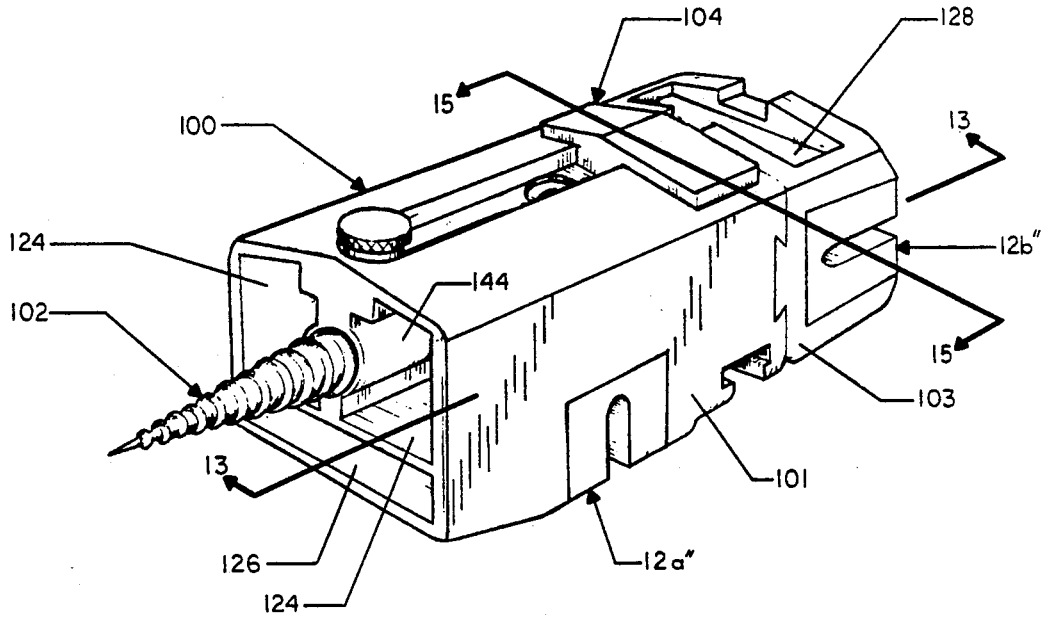
FIG. 12 is a perspective view of a third embodiment of an apparatus for supporting archery equipment according to the invention.

The mounting means 51 of the second embodiment comprises a cylindrical bolt 58 with a threaded screw 60 extending axially from one end and a coil spring 62 axially disposed at the opposite end as shown in FIG. 11. The spring 62 is received in a seat defined by an axial channel 63 in the bolt 58. A lever 66 is mounted to the side of the bolt 58 by any conventional means and extends radially therefrom. The bolt 58 operates in an axial channel 54 in conjunction with an H-shaped channel 68 in the surface 10*c'*. The channel 68 is defined by a first recess 70, a second recess 72 and a cross channel 74.

Figure 10:
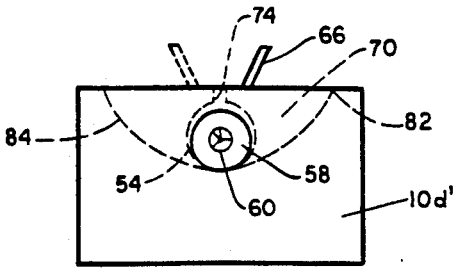
FIG. 10 is an end view of the holder taken along lines 10—10 of FIG. 9.

The axial channel 54 is in open communication with the cross channel 74, parallel thereto, and is generally cylindrical, being dimensioned to receive the bolt 58 slidably and rotatably therein, with the lever 66 projecting outwardly of surface 10*c'* in the H-shaped channel 68. An aperture 76 in the surface 10*d'* is disposed in registry with the axial channel 54. The screw 60 extends through aperture 76 and the spring 62 bears against a side wall 78 of the second recess 72 to bias the bolt 58 and thus the screw 60 outwardly of the block 10'. However, outward movement of the bolt 58 and screw 60 is limited by the lever 66 contacting a side wall 80 of the first recess 70 which acts as a stop. When the lever 66 is moved to either end of the first recess 70, the bolt 58 is restrained from movement either in the outward or inward direction, and the screw 60 may be driven into or removed from the tree or other surface by rotation in a conventional manner. It will be apparent that when the lever 66 is disposed adjacent a first end 82 of the recess 70, the bolt 58 is further restrained from rotation about its longitudinal axis in the clockwise direction as shown in FIG. 10, allowing the block 10' to be driven into the support surface. Conversely, when the lever 66 is disposed adjacent a second end 84 of the first recess 70, the bolt 58 is restrained from counterclockwise movement, thus permitting removal of the device by rotating the block 10' in the opposite direction.

When the lever 66 is forced through the cross channel 74 against the spring bias, the screw 60 may be retracted through the aperture 76 into the axial channel 54. In this position, the lever 66 may be disposed at either end 86, 88 of the second recess 72, whereupon it will bear against a second side wall 90 of the second recess 72 to restrain movement of the bolt 58 and screw 60 in the outward direction. It will be apparent that the combination of the lever 66 and the spring 62 makes one-handed operation relatively easy.

With the screw 60 in the extended position, the arrow- and quiver-holding block 10' can be driven into the side of a tree and positioned such that the arrow channel 18' is vertically oriented. The bowman may then place an arrow into the arrow channel 18' where it will be frictionally retained by the foam pads 20'. The lip of the arrow protection cup of a typical bow quiver will fit into the quiver slot 56 to mount the quiver on the tree as well.

A third embodiment of the invention is shown in FIGS. 12–19. In this embodiment, as in the first and second embodiments, like parts are identified with like numerals, differentiated only by prime or double prime. A holder 100 comprises a primary block 101 and an add-on block 103. The primary block 101 includes a quiver-attachment means 104, a first arrow-presenting means 12*a''*, and a telescoping, screw-threaded mounting means 102 for mounting the holder to a support surface. The add-on block 103 houses a second arrow-presenting means 12*b''*. The primary block 101 is machined to form a hollow cylinder 144 and cavities 124 in the interior of the holder. A recess 126 is provided near one side of the holder and extends longitudinally thereof. Machined into opposite sides of the add-on block 103 are recesses 128 which extend longitudinally thereof. The recesses and cavities reduce the weight of the holder so that it will be easier for the bowman to carry.

Figure 13:
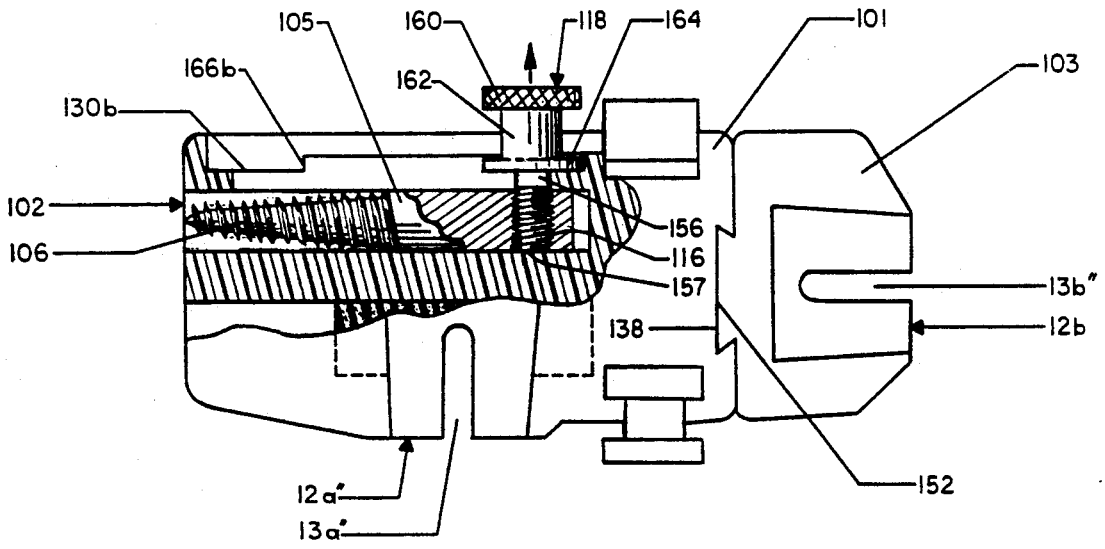
FIG. 13 is a front elevational view of the holder taken along lines 13—13 of FIG. 12 partly in cross section and showing the holder mounting means in a first position.
Figure 14:
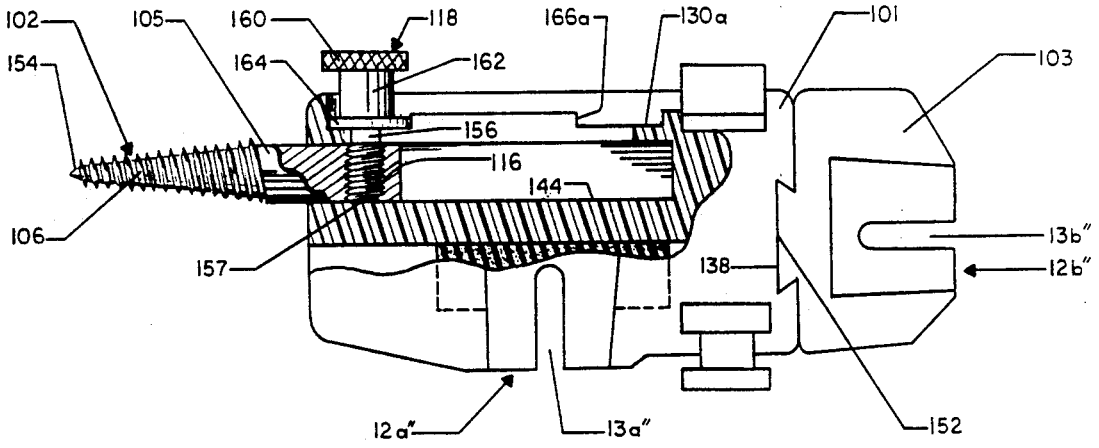
FIG. 14 is a view similar to the view shown in FIG. 13 but showing the holder mounting means in a second position.
Figure 19:
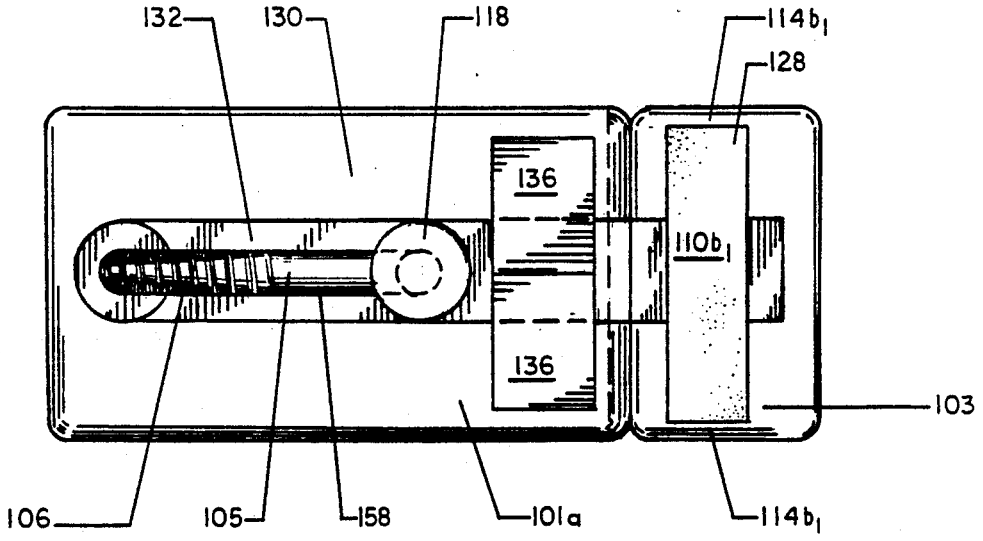
FIG. 19 is a top plan view of the holder of FIGS. 12–18.

As shown in FIGS. 13 and 14, the mounting means 102 comprises a thumbscrew 118 and a screw 106 which extends axially from one end of a cylindrical bolt 105 and is tapered to provide a sharp tip 154 for easy insertion into a vertical support such as a tree. The thumbscrew 118 includes a shaft 156 having a threaded portion which engages a threaded aperture 116 extending transversely through the cylindrical bolt 105. The thumbscrew 118 also includes a knurled cylindrical surface 160, an intermediate cylindrical surface 162, and a lower cylindrical surface 164 which is integral with the shaft 156. As best shown in FIG. 19, a surface 101*a* of the holder has a recess 132 which extends longitudinally of the surface 101*a*. Machined into the recess 132 is a slot 158 which extends longitudinally of the recess 132.

As shown in FIGS. 13 and 14, the cylindrical bolt 105 telescopes within the cylinder 144 between a first position and a second position. The first position is the position of the cylindrical bolt relative to the cylinder when the lower cylindrical surface 164 of the thumbscrew 118 is disposed within a cylindrical seat 130*a* formed in the recess 132 and the threaded portion of the shaft 156 engages the threaded aperture 116. The second position is the position of the cylindrical bolt relative to the cylinder when the lower cylindrical surface 164 is disposed within a cylindrical seat 130*b* formed in the recess 132 and the threaded portion of the shaft 156 engages the threaded aperture 116. When the cylindrical bolt is in the first position, the threaded screw 106 which is axially mounted to the cylindrical bolt 105 does not protrude outside the cylinder 144; in the second position, no portion of the threaded screw 106 is disposed within the cylinder 144.

While the cylindrical bolt is in the first position, it can be secured by turning the thumbscrew 118 in a clockwise direction until a bottom surface 157 of the threaded portion of the thumbscrew shaft 156 bears against an inner wall of the cylinder 144. An annular side wall 166*a* of the seat 130*a* prevents the mounting means 102 from moving longitudinally of the holder. To move the cylindrical bolt and its integrally mounted screw 106 from the first position to the second position, the knurled cylindrical surface 160 of the thumbscrew is grasped and turned in a counterclockwise direction. The thumbscrew should be turned until the bottom surface 157 of the threaded portion of the shaft 156 no longer bears against the inner wall of the cylinder 144 and until movement of the lower cylindrical surface 164 is not constrained by the annular side wall 166*a* of the seat 130*a*. The thumbscrew should not be turned so far that the shaft 156 becomes disengaged from the aperture 116 of the cylindrical bolt. The thumbscrew 118 can then be moved longitudinally of the holder which causes a corresponding movement of the cylindrical bolt 105 and the screw 106 such that the screw 106 extends outside of the cylinder 144. The thumbscrew 118 can be positioned above the seat 130*b* in preparation for securing the cylindrical bolt 105 in the second position. The cylindrical bolt can be secured in the second position by turning the thumbscrew 118 in a clockwise direction until the bottom surface 157 of the threaded portion of the shaft 156 bears against the inner side wall of the cylinder 144. When secured in this second position, the lower cylindrical surface 164 of the thumbscrew will be constrained from moving longitudinally of the holder by an annular side wall 166*b* of the seat 130*b*.

In operation, a bowman who is carrying the device of the invention can safely carry the device by positioning the cylindrical bolt 105 in the first position such that the tip 154 of the screw 106 does not protrude outside of the holder. When desired, the device can be mounted to a support surface such as a tree by moving the cylindrical bolt from the first position to the second position, then placing the tip of the screw against the support surface, and then rotating the holder 100 in a clockwise direction.

Figure 15:
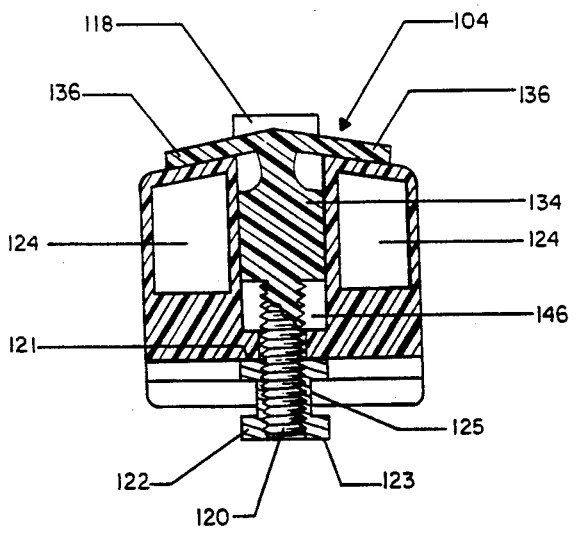
FIG. 15 is a cross section of the holder taken along lines 15—15 of FIG. 12 showing the quiver-attachment means of the holder in a first position.
Figure 16:
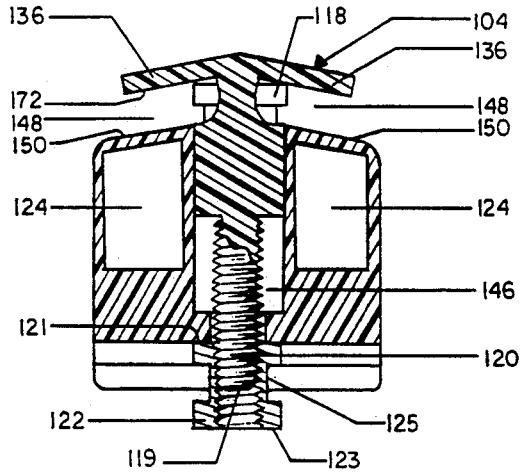
FIG. 16 is a view similar to the view shown in FIG. 15 but showing the quiver-attachment means in a second position.
Figure 16A:
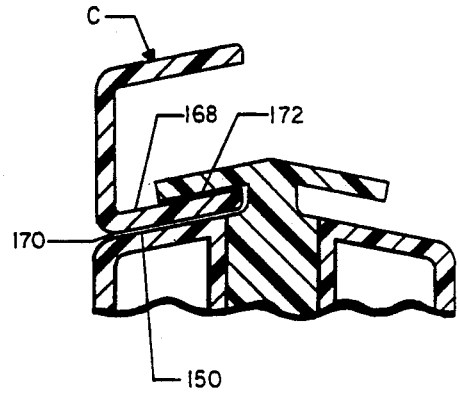
FIG. 16A is a view similar to the views shown in FIGS. 15 and 16 but showing the quiver-attachment means in a third position, clamping a cup of a quiver.

The quiver-attachment means 104 is shown in detail in FIGS. 15, 16 and 16A. An internally threaded holding knob 122 is disposed within a T-channel 125 of the primary block 101 and rotatively coupled thereto. A screw 120 threadably engages the internally threaded holding knob 122. Integral with the screw 120 is a rectangular block 134 which telescopes within a recess 146 of the holder. Integral with the telescoping rectangular block 134 are tongues 136 which move in unison with the block 134. The tongues 136 can move to and between a first position, a second position, and a third position. The first position is the position wherein inner tongue surfaces 172 of the tongues 136 engage surfaces 150 of the holder. The second position is shown in FIG. 16 wherein the tongue surfaces 172 become disengaged from the holder surfaces 150 to form an opening 148 which is large enough to permit insertion of a conventional quiver cup C therein. The third position is shown in FIG. 16A wherein an interior surface 168 and an exterior surface 170 of the quiver cup C are firmly clamped in either of the openings 148 by the tongue surface 172 and the holder surface 150. In the third position, the tongue surface 172 bears against the interior surface 168 of the quiver cup, and the holder surface 150 bears against the exterior surface 170 of the quiver cup.

Each tongue 136 is inclined to form a planar surface parallel to the holder surface 150 it bears against while in the first position. In the preferred embodiment, each of these pairs of planar surfaces forms an eighty degree angle with a plane extending longitudinally of the screw 120. In other words, each tongue 136 forms a planar surface inclined ten degrees from the horizontal plane which is normal to the plane extending longitudinally of the screw 120.

Thus, in operation, the quiver-attachment means 104 can be moved from the first position shown in FIG. 15 to the second position shown in FIG. 16 by rotating the holding knob 122 in a counterclockwise direction. Since the holding knob is rotatively coupled to the T-channel 125 of the primary block, rotation of the holding knob causes an end 119 of the threadably engaged screw 120 to telescope toward the recess 146 or away from it. A counterclockwise rotation of the holding knob forces the end 119 of the screw 120 to telescope toward the recess 146, causing the rectangular block 134 to telescope away from the holding knob, thereby causing the tongues 136 to move to the second position. The quiver cup can then be placed within either of the openings 148 and can be firmly secured therein by rotating the knob 122 in a clockwise direction which causes the tongues 136 to move toward the third position, thereby securing the quiver cup within the opening 148. When the quiver cup is secured in the third position, arrows mounted within the cup extend in a direction generally parallel to the planar surface formed by whichever tongue 136 is engaging the cup. In the preferred embodiment, the arrows extend in a direction ten degrees away from the horizontal plane described above. When the arrows are held in this spatial relationship, the bowman may easily remove them from the quiver cup.

Figure 17:
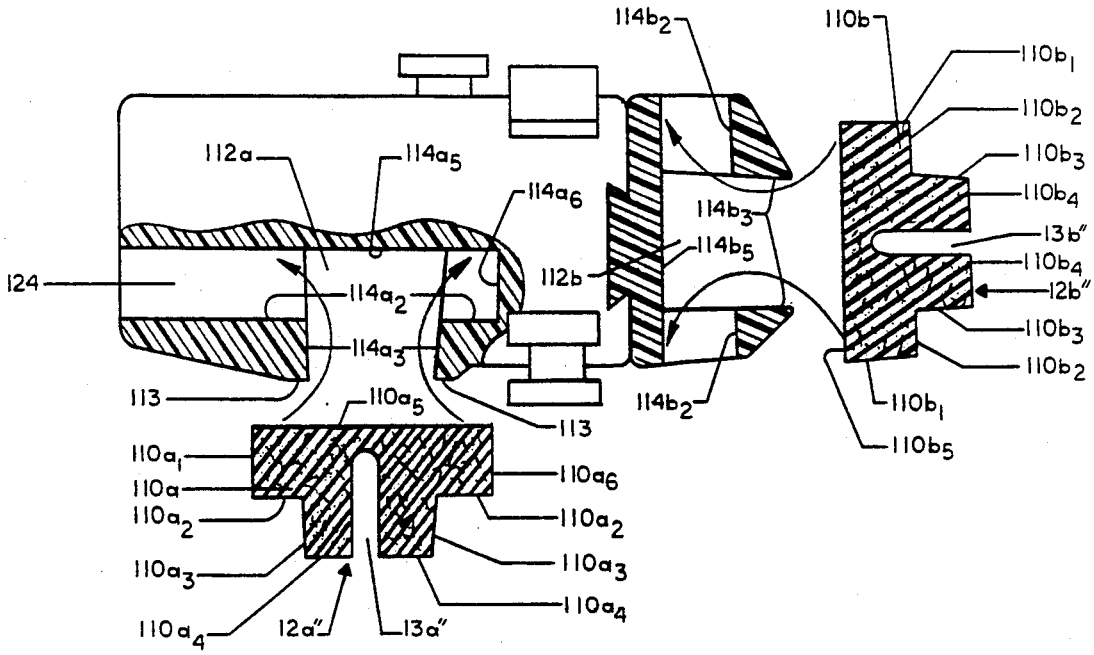
FIG. 17 is a front elevational view of the holder of FIG. 12 partly in cross section to show the interior construction of the arrow-presenting means.

The interior constructions of the first arrow-presenting means 12*a*″ and the second arrow-presenting means 12*b*″ are shown in FIG. 17. Each arrow-presenting means 12*a*″ and 12*b*″ includes a resilient foam pad which has a longitudinally extending slot 13*a*″ and 13*b*″, respectively, formed therein. A resilient foam pad 110*a* can be placed within an arrow channel 112*a* formed in the holder by compressing the foam pad and then placing the whole pad within the arrow channel such that its surfaces engage channel walls 114*a* of the arrow channel 112*a*. A surface $\mathbf{110}a_1$ of the foam pad will not contact a channel wall because it is disposed within the cavity 124 of the holder. Two surfaces $\mathbf{110}a_4$ which have the slot 13*a*″ disposed between them do not bear against any channel wall and are preferably flush with surfaces 113 of the holder.

The second arrow-presenting means 12*b*″ is similarly constructed. A foam pad 110*b* can be compressed to fit within an arrow channel 112*b* such that it engages channel walls 114*b* of the arrow channel 112*b*. Side $\mathbf{110}b_5$ of the foam pad will then bear against wall $\mathbf{114}b_5$ of the channel. Two sides $\mathbf{110}b_2$ and two sides $\mathbf{110}b_3$ of the foam pad will bear against two walls $\mathbf{114}b_2$ and two walls $\mathbf{114}b_3$, respectively, of the channel 112*b*. As shown in FIG. 19, two joist-like walls $\mathbf{114}b_1$ form the ends of the recess 128 in the block 103. After insertion of the foam pad into the channel, a large portion of one side $\mathbf{110}b_1$ of the foam pad projects through the recess 128. The opposite side of the add-on block 103 is similarly constructed.

Figure 18:
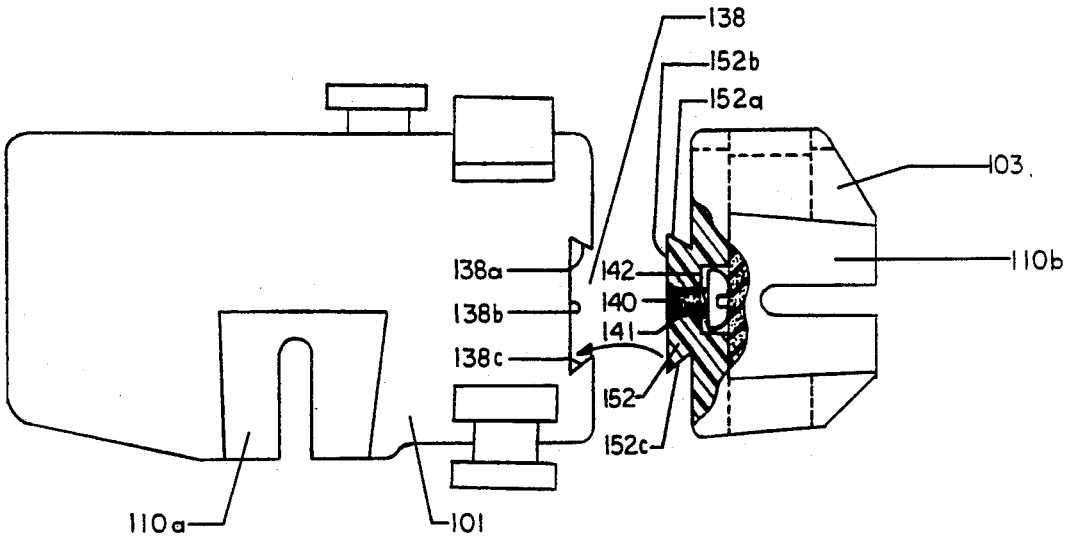
FIG. 18 is a front elevational view of the holder of FIG. 12 partially broken away to show interior detail of the second arrow-presenting means.

Referring to FIG. 18, the primary block 101 has a dovetail shaped channel 138 machined into it. The channel includes a back wall 138*b* extending transversely of the primary block, and inclined surfaces 138*a* and 138*c* which also extend transversely of the primary block and form side walls of the channel. As shown in FIGS. 17 and 18, the wall 114*b*$_5$ has a recess for holding a head of a screw 140 which is threadably engaged within an internally threaded aperture 141 of the add-on block 103. The add-on block 103 has a dovetail shaped tongue 152 which has the same shape as the channel 138 which slidably receives the tongue 152. To attach the add-on block 103 to the primary block 101, the resilient foam pad 110*b* must be removed from the remainder of the add-on block, causing the head of the screw 140 to be exposed. The tongue 152 of the add-on block is then inserted within the channel 138, and the block 103 is then moved until it and the primary block are appropriately aligned. A conventional screwdriver can then be used to turn the screw 140 in a clockwise direction such that the head of the screw 140 moves in the direction of a stop 142 formed in the recess of the wall 114*b*$_5$. By turning the screw clockwise, the screw 140 bears against the channel wall 138*b*, thus causing the screw 140 to remain stationary with respect to the primary block 101. Because the screw 140 is held in a stationary position with respect to the primary block 101, a clockwise turning of the screw causes the threadably engaged add-on block 103 to move away from the primary block. After a sufficient number of clockwise turns of the screw, inclined surfaces 152*a* and 152*c* of the add-on block will bear against the surfaces 138*a* and 138*c*, respectively, of the primary block. The effect of the clockwise turning of the screw is to constrain the add-on block from moving away from the primary block, thus securing the add-on block to the primary block. The foam pad 110*b* can then be compressed and placed within the arrow channel 112*b*.

Reasonable variation and modification are possible within the spirit of the foregoing specification and drawings without departing from the scope of the invention. For example, the holders 10 and 100 may include either the arrow-presenting means or the quiver-attachment means instead of both. Likewise, the holder 100 may be provided with only one arrow-presenting means instead of two. Also, the arrow-presenting means may provide for holding an arrow by snap fit engagement rather than foam pads. Similarly, the screw 16 may be retained in the extended or retracted position by any of a number of well-known means.

The embodiments for which an exclusive property, or privilege is claimed are defined as follows:

1. An apparatus for supporting a quiver and arrows comprising:

a block;

a mounting screw movably mounted to the block for movement between a first position where a substantial portion of the screw is retracted within the block and a second position where a substantial portion of the screw extends from the block;

an arrow shaft gripping element on the block for releasably frictionally gripping the shaft of a single arrow; and a quiver support on the block adapted to removably mount a quiver to the block whereby the block can be easily transported to a point of use when the screw is in the first position, and thereafter be securely mounted to a vertical support when the screw is in the second position, adapted to retain a single arrow for easy retrieval, and support a quiver in a fixed position relative to the vertical support.

2. An apparatus for supporting a quiver and arrows according to claim 1 wherein the quiver support further comprises a clamping element movably mounted to the block for clamping a portion of the quiver to the block.

3. An apparatus for supporting a quiver and arrows according to claim 2 wherein the block has a first side, and the clamping element includes a body slidably received within a recess in the block and a flange member connected to the body, said flange member disposed exterior to the block and adapted to bear against the first side of the block in clamping engagement.

4. An apparatus for supporting a quiver and arrows according to claim 3 wherein the body slidably moves along an axis and has a threaded shaft extending parallel to the axis, a nut is mounted to the block for rotation about the axis but constrained against movement along the axis, and the threaded shaft engages the nut so that rotation of the nut will cause movement of the body along the axis relative to the block.

5. An apparatus for supporting a quiver and arrows according to claim 4 wherein the block has a second side opposite the first side and a T-channel in the second side, the nut being disposed within the T-channel.

6. An apparatus for supporting a quiver and arrows according to claim 5 wherein the arrow shaft gripping element comprises a side of the block defining a channel, and a resilient pad is disposed within the channel to frictionally grip and retain an arrow shaft therein.

7. An apparatus for supporting a quiver and arrows according to claim 1 further comprising a second block removably mounted to the block wherein the second block has an arrow shaft gripping element for releasably frictionally gripping the shaft of a single arrow.

8. An apparatus for supporting a quiver and arrows comprising:

a block; and a quiver support on the block adapted to removably mount a quiver to the block, the quiver support further comprising a clamping element movably mounted to the block for clamping a portion of the quiver to the block wherein the block includes a first side having a sloped surface, and the clamping element includes a body slidably received within a recess in the block and an angled flange member connected to the body, said angled flange member disposed exterior to the block and adapted to bear against the sloped surface of the first side of the block in clamping engagement.

9. An apparatus for supporting a quiver and arrows according to claim 8 wherein the body slidably moves along an axis and has a threaded shaft extending parallel to the axis, a nut is mounted to the block for rotation about the axis but constrained against movement along the axis, and the threaded shaft engages the nut so that rotation of the nut will cause movement of the body along the axis relative to the block.

10. An apparatus for supporting a quiver and arrows according to claim 8 further comprising a second block removably mounted to the block wherein the second block has an arrow shaft gripping element for releasably gripping the shaft of a single arrow.

11. An apparatus for supporting a quiver and arrows according to claim 8 further comprising an arrow shaft gripping element on the block for releasably gripping the shaft of a single arrow.

12. An apparatus for supporting a quiver and arrows according to claim 11 wherein the arrow shaft gripping element comprises a side of the block defining a channel, and a resilient pad is disposed within the channel to frictionally grip and retain an arrow shaft therein.

13. An apparatus for supporting a quiver and arrows comprising:

a block; and a quiver support on the block adapted to removably mount a quiver to the block, the quiver support further comprising a clamping element movably mounted to the block for clamping a portion of the quiver to the block wherein the block has a first side, and the clamping element includes a body slidably received within a recess in the block and a flange member connected to the body, said flange member disposed exterior of the block and adapted to bear against the first side of the block in clamping engagement and wherein the body slidably moves along an axis and has a threaded shaft extending parallel to the axis, a nut is mounted to the block for rotation about the axis but constrained against movement along the axis, and the threaded shaft engages the nut so that rotation of the nut will cause movement of the body along the axis relative to the block and wherein the block has a second side opposite the first side and a T-channel in the second side, the nut being disposed within the T-channel.

14. An apparatus for supporting a quiver and arrows comprising:

a block having a first side;

a mounting screw movably mounted to the block for movement between a first position where a substantial portion of the screw is retracted within the block and a second position where a substantial portion of the screw extends from the block;

an arrow shaft gripping element on the block for releasably gripping the shaft of a single arrow; and a quiver support on the block adapted to removably mount a quiver to the block whereby the block can be easily transported to a point of use when the screw is in the first position, and thereafter be securely mounted to a vertical support when the screw is in the second position, said quiver support further comprising a clamping element movably mounted to the block for clamping a portion of the quiver to the block wherein the clamping element includes a body slidably received within a recess in the block and a flange member connected to the body, said flange member disposed exterior to the block and adapted to bear against the first side of the block in clamping engagement and wherein the body slidably moves along an axis and has a threaded shaft extending parallel to the axis, a nut is mounted to the block for rotation about the axis but constrained against movement along the axis, and the threaded shaft engages the nut so that rotation of the nut will cause movement of the body along the axis relative to the block.

15. An apparatus for supporting a quiver and arrows according to claim 14 wherein the block has a second side opposite the first side and a T-channel in the second side, the nut being disposed within the T-channel.

16. An apparatus for supporting a quiver and arrows according to claim 15 wherein the arrow shaft gripping element comprises a side of the block defining a channel, and a resilient pad is disposed within the channel to frictionally grip and retain an arrow shaft therein.

* * * * *